US006952930B1

(12) United States Patent
Rafalovich et al.

(10) Patent No.: US 6,952,930 B1
(45) Date of Patent: Oct. 11, 2005

(54) METHODS AND APPARATUS FOR CONTROLLING REFRIGERATORS

(75) Inventors: Alexander Pinkus Rafalovich, Louisville, KY (US); Anil Kumar Tummala, Louisville, KY (US); Ziquang Hu, Prospect, KY (US); John Charles Steimel, Louisville, KY (US)

(73) Assignee: General Electric Company, Schenectady, NY (US)

( * ) Notice: Subject to any disclaimer, the term of this patent is extended or adjusted under 35 U.S.C. 154(b) by 164 days.

(21) Appl. No.: 10/403,677

(22) Filed: Mar. 31, 2003

(51) Int. Cl.[7] ..... F25B 5/00
(52) U.S. Cl. ..... 62/117; 62/199; 62/200
(58) Field of Search ..... 62/117, 199, 200, 62/82, 151

(56) References Cited

U.S. PATENT DOCUMENTS

| | | | | |
|---|---|---|---|---|
| 3,659,579 A | | 5/1972 | Henderson et al. | |
| 3,926,008 A | * | 12/1975 | Webber | 62/200 |
| 4,021,642 A | | 5/1977 | Fields, Jr. | |
| 4,163,894 A | | 8/1979 | Scherer | |
| 4,327,274 A | | 4/1982 | White et al. | |
| 4,337,384 A | | 6/1982 | Tanaka et al. | |
| 4,712,383 A | * | 12/1987 | Howland et al. | 62/200 |
| 4,831,225 A | | 5/1989 | Ishifuro et al. | |
| 4,942,741 A | * | 7/1990 | Hancock et al. | 62/292 |
| 5,065,587 A | * | 11/1991 | Howland et al. | 62/131 |
| 5,077,982 A | | 1/1992 | Shaffer, Jr. | |
| 5,140,120 A | | 8/1992 | Kasai et al. | |
| 5,168,713 A | * | 12/1992 | Howland | 62/117 |
| 5,272,963 A | | 12/1993 | Del Fabbro | |
| 5,434,390 A | | 7/1995 | McKee et al. | |
| 5,465,591 A | | 11/1995 | Cur et al. | |
| 5,525,782 A | | 6/1996 | Yoneno et al. | |
| 5,694,779 A | | 12/1997 | Matsushima et al. | |
| 5,918,589 A | | 7/1999 | Valle et al. | |
| 6,016,662 A | | 1/2000 | Tanaka et al. | |
| 6,058,723 A | * | 5/2000 | Kusunoki et al. | 62/156 |
| 6,060,701 A | | 5/2000 | McKee et al. | |
| 6,140,626 A | | 10/2000 | McKee et al. | |
| 6,167,712 B1 | * | 1/2001 | Lim et al. | 62/113 |
| 6,209,332 B1 | | 4/2001 | Strauss | |
| 6,250,296 B1 | | 6/2001 | Norris et al. | |
| 6,262,406 B1 | | 7/2001 | McKee et al. | |
| 6,291,808 B1 | | 9/2001 | Brown | |
| 6,360,552 B1 | * | 3/2002 | Lee et al. | 62/200 |
| 6,370,895 B1 | * | 4/2002 | Sakuma et al. | 62/199 |
| 6,370,908 B1 | * | 4/2002 | James | 62/434 |
| 6,376,817 B1 | | 4/2002 | McFadden et al. | |
| 6,397,608 B1 | | 6/2002 | Sakuma et al. | |
| 6,403,937 B1 | | 6/2002 | Day et al. | |
| 6,460,357 B1 | * | 10/2002 | Doi et al. | 62/199 |
| 6,526,769 B2 | * | 3/2003 | Kim | 62/199 |
| 6,622,498 B2 | * | 9/2003 | Park et al. | 62/154 |
| 2004/0074247 A1 | * | 4/2004 | Peruzzo et al. | |

FOREIGN PATENT DOCUMENTS

| | | | |
|---|---|---|---|
| JP | 362279828 A | * | 12/1947 |
| JP | 352028751 A | * | 3/1977 |

* cited by examiner

*Primary Examiner*—William E. Tapolcai
*Assistant Examiner*—Mohammad M. Ali
(74) *Attorney, Agent, or Firm*—H. Neil Houser, Esq.; Armstrong Teasdale LLP

(57) ABSTRACT

A refrigerator includes a refrigeration compartment having an upper region and a lower region, a first evaporator positioned in the upper region, a second evaporator, positioned in the lower region, and a fan disposed between the first and second evaporators. The fan is configured, such that air flows past first and second evaporators and is discharged into said upper and lower regions when said fan is energized.

13 Claims, 17 Drawing Sheets

Y

| | | | |
|---|---|---|---|
| FZ EXTREME | 30 AE<br>Area = Area5<br>COMP MED/ Cond - SuperHi<br>FZ Fan Hi<br>Valve B<br>FF Fan Off | 31 AF<br>Area = Area5<br>COMP MED/ Cond - SuperHi<br>FZ Fan Hi<br>Valve B<br>FF Fan Off | 32 AH<br>Area = Area7<br>COMP MED/ Cond - SuperHi<br>FZ Fan Med<br>Valve NC<br>FF Fan NC |
| FZ HIGH HYST 3 (FZXXHiHyst) | 0 A<br>Area = Area5<br>Comp Hi<br>FZ Fan Hi<br>Valve B<br>FF Fan Off | 1 B<br>Area = Area5<br>COMP Hi<br>FZ Fan HIGH<br>Valve B<br>FF Fan OFF | 2 C Area 1<br>If (Valve NOT A) Area = Area1,<br>Comp Hi<br>FZ Fan High<br>Valve NC<br>FF Fan NC |
| FZ HIGH HYST 2 (FZXHiHyst) | 6 G<br>Area = Area5<br>Comp Med<br>FZ Fan Med<br>Valve B<br>FF Fan Off | 7 H<br>Area = Area5<br>Comp Med<br>FZ Fan Med<br>Valve B<br>FF Fan Off | 8 I Area 2<br>If NOT from Area1,<br>if (Area NOT Area 3) Comp Med<br>if (Valve NOT A) Fz Fan Med<br>Valve NC<br>FF Fan NC<br>Area = Area2 |

Fig. 7C

Fig. 7B

FIG. 7A

380

| | | |
|---|---|---|
| 33 AH<br>Area = Area7<br>COMP MED/ Cond - SuperHi<br>FZ Fan Med<br>Valve C<br>FF Fan Med | 34 AI<br>Area = Area7<br>COMP MED/ Cond - SuperHi<br>FZ Fan Med<br>Valve C<br>FF Fan Med | 35 AJ<br>Area = Area7<br>COMP MED/ Cond - SuperHi<br>FZ Fan Med<br>Valve C<br>FF Fan MED |
| 3 D Area1<br>Area = Area1<br>Comp Hi<br>FZ Fan High<br>Valve C<br>FF FAN LOW | 4 E Area1<br>Area = Area1<br>Comp Hi<br>FZ Fan High<br>Valve C<br>FF FAN MED | 5 F Area1<br>Area = Area1<br>Comp Hi<br>FZ Fan High<br>Valve C<br>FF Fan High |
| 9 J Area 2<br>If NOT from Area1,<br>Comp Med, FZ Fan Med<br>Area = Area2<br>Valve C, FF Fan Low<br>else if (Valve =B) Valve C | 10 K Area 2<br>If NOT from Area1,<br>Comp Med<br>FZ Fan Med<br>Valve C<br>FF FAN MED<br>Area = Area2 | 11 L Area 1<br>Area = Area1<br>COMP HIGH<br>FZ Fan Med<br>Valve C<br>FF Fan High |

Fig. 7D

Fig. 7A

FIG. 7B

Fig. 7A

| | | | |
|---|---|---|---|
| FZ HIGH HYST 1 (FZHiHyst) | 12 M<br>Area = Area5<br>Comp LOW<br>FZ Fan Low<br>Valve B<br>FF Fan Off | 13 N<br>Area = Area5<br>Comp LOW<br>FZ Fan Low<br>Valve B<br>FF Fan Off | 14 O Area 3<br>if Area = Area1<br>Comp Med, FZ Fan Med<br>Valve C, Area = Area2<br>else Comp Low, if (Valve NOT A)<br>Fz Fan Low<br>Valve NC, Area = Area3<br>FF Fan NC |
| FZ Target Temp | 18 S<br>Area = Area5<br>Comp NC<br>FZ Fan NC<br>Valve NC<br>FF Fan Off | 19 I<br>Area = Area5<br>if (Comp On)<br>Comp Low, FZ Fan Low<br>Valve B<br>else Valve A, Comp NC, Fz Fan NC<br>FF Fan OFF | 20 U Area 4<br>If Area = Area2<br>Comp Low, Fz Fan Low<br>Valve A Area = Area 3<br>else Comp NC, Valve NC, FZ Fan<br>Area = Area4<br>FF Fan NC |
| FZ Low Hysteresis | 24 Y Area = Area0<br>COMP OFF<br>FZ Fan OFF<br>Valve A<br>FF Fan OFF | 25 Z Area = Area0<br>COMP OFF<br>FZ Fan OFF<br>Valve A<br>FF Fan OFF | 26 AA Area = Area0<br>COMP Off<br>FZ Fan OFF<br>Valve A<br>FF Fan NC |
| | FF No Freeze | FF Low Hysteresis | FF Target Temp |

390

Fig. 7E

Fig. 7D

FIG. 7C

| | | |
|---|---|---|
| 15 P Area 3<br>if Area = Area1<br>Comp Med, FZ Fan Med<br>Valve C, Area = Area2<br>else Comp Low, Fz Fan Off<br>Valve A, Area = Area3<br>FF Fan Low | 16 Q Area 2<br>if NOT from Area1<br>Comp Med<br>FZ Fan Off<br>Valve A<br>FF FAN MED | 17 R Area 1<br>Area = Area1<br>COMP Med<br>Fz Fan Off<br>Valve A<br>FF FAN HIGH |
| 21 V Area 3<br>Comp Low, Fz Fan Off<br>Valve A<br>Area = Area3<br>FAN LOW | 22 W Area 2<br>Comp Med<br>Fz Fan Off<br>Valve A<br>Area = Area2<br>FF FAN MED | 23 X Area 1<br>Area = Area1<br>COMP Med<br>FZ Fan Off<br>Valve A<br>FF Fan High |
| 27 AB<br>Area = Area6<br>COMP LOW<br>FZ Fan Off<br>Valve A<br>FF FAN LOW | 28 AC<br>Area = Area6<br>COMP LOW<br>FZ Fan Off<br>Valve A<br>FF FAN MED | 29 AD<br>Area = Area6<br>COMP MED<br>FZ Fan Off<br>Valve A<br>FF Fan High |

Fig. 7B

X

Fig. 7C

| | | |
|---|---|---|
| FF HIGH<br>HYST 1<br>(FFHi<br>Hyst) | FF HIGH<br>HYST 2<br>(FFXHi<br>Hyst) | FF HIGH<br>HYST 3<br>(FFXXHi<br>Hyst) |

Fig. 7F

FIG. 7D

Fig. 7C

*If Valve is in A position FZFan is off and FFFan runs atleast in Low Speed*
*If Valve is in B position FZFan runs atleast in Low speed and FFFan is off*
*If Valve is in C position FZ and FF fans run atleast in Low Speed*

NOTE (1): DAMPER OPENS & FF FAN ON LOW AT SS START, THEN CHECKS FOR PROPER POSITION NEXT LOGIC
NOTE (2): FOR BPO & QUANTUM FZ Fan LOW = FZ Fan MEDIUM NA
NOTE (3): If the FF temperature has not gotten colder by 0.15 F within 30 minutes of the damper opening, boost the FZ
NOTE (4): EFOSSO = evaporator fan on sealed system off (part of the configuration byte)

```
FFRollAvg = FFTHERMIST
  FZRollAvg = FZTHERMIST
  FFLTAVG3 = Beta * FFLTAVG3 + (1 - Beta) * FFRollAvg ' added by RMB
  FFLTAVG3 = Beta * FZLTAVG3 + (1 - Beta) * FZRollAvg ' added by RMB
  FFLTAVG2 = Beta * FFLTAVG2 + (1 - Beta) * FFLTAVG3 ' added by RMB
  FZLTAVG2 = Beta * FZLTAVG2 + (1 - Beta) * FZLTAVG3 ' added by RMB
  FFLTAVG = Beta * FFLTAVG + (1 - Beta) * FFLTAVG2 ' moved by RMB
  FZLTAVG = Beta * FFLTAVG + (1 - Beta) * FZLTAVG2 ' moved by RMB
```

```
If (FFLTAVG - (TFFTARGET +FFOFF) > 1) Then
  FFERROR = FFERROR - 0.1
  ElseIf (FFLTAVG - TFFTARGET - FFOFF > 0.2) Then
  FFERROR = FFERROR - 0.02
  ElseIf (FFLTAVG - TFFTARGET - FFOFF < -1) Then
  FFERROR = FFERROR + 0.1
  ElseIf (FFLTAVG - TFFTARGET - FFOFF < -0.2) Then
  FFERROR = FFERROR + 0.02

End If
If FFERROR > FFHiHyst+2 Then FFERROR = FFHiHyst+2
If FFERROR < FFLowHyst Then FFERROR = FFLowHyst
```

LOGIC GRID

Fig. 7F

FIG. 7E

Fig. 7D

NOTE (5): ONF = obey no freeze limit (part of the configuration byte)
NOTE (6): MS = medium speed (part of the configuration byte)
NOTE (7): See included worksheet in order to calculate the configuration byte

```
If (FZLTAVG - (TFRTARGET +FZOFF) > 1) Then
   FZERROR = FZERROR - 0.1
   ElseIf (FZLTAVG - TFRTARGET - FZOFF > 0.2) Then
   FZERROR = FZERROR - 0.02
   ElseIf (FZLTAVG - TFRTARGET - FZOFF < -1) Then
   FZERROR = FZERROR + 0.1
   ElseIf (FZLTAVG - TFRTARGET - FZOFF < -0.2) Then
   FZERROR = FZERROR + 0.02
End If
If FZERROR > FZHiHyst Then FZERROR = FZHiHyst
If FZERROR < FZLowHyst Then FZERROR = FZLowHyst
```

Fig. 7E

FIG. 7F

METHODS AND APPARATUS FOR CONTROLLING REFRIGERATORS

BACKGROUND OF THE INVENTION

This invention relates generally to refrigerators, and more particularly, to control systems for refrigerators.

Some known refrigerators include a fresh food compartment and a freezer compartment. Such a refrigerator also typically includes a refrigeration sealed system circuit including a compressor, an evaporator, and a condenser connected in series. An evaporator fan is provided to blow air over the evaporator, and a condenser fan is provided to blow air over the condenser.

In operation, when an upper temperature limit is reached in the freezer compartment, the compressor, evaporator fan, and condenser fan are energized. Once the temperature in the freezer compartment reaches a lower temperature limit, the compressor, evaporator fan, and condenser fan are de-energized.

Some known frost free refrigerators include a refrigeration defrost system to limit frost buildup on evaporator coils. Conventionally, an electromechanical timer is used to energize a defrost heater after a pre-determined run time of the refrigerator compressor to melt frost buildup on the evaporator coils. After defrost, the compressor is typically run for a predetermined time to lower the evaporator temperature and reduce food spoilage in the refrigerator and/or fresh food compartments of a refrigeration appliance.

BRIEF DESCRIPTION OF THE INVENTION

In one aspect, a method of switching refrigerant flow between a path to a fresh food evaporator in a fresh food compartment and a path to a freezer evaporator in a freezer food compartment of a refrigerator using a three way valve includes providing the three way valve with a plurality of operation positions, the three way valve having a plurality of steps between each of the plurality of operation positions and moving the three way valve incrementally in steps with a time delay between consecutive steps between at least two operation positions such that the three way valve transitions between at least two operation positions gradually.

In another aspect, a method for operating a refrigerator having a fresh food compartment and a freezer food compartment, wherein both compartments include an evaporator, the method includes cooling the fresh food compartment using a control grid and cooling the freezer food compartment using a control grid.

In another aspect, a method for defrosting a refrigerator having a refrigerant path to a freezer evaporator and a refrigerant path to a fresh food evaporator, and a three way valve for controlling refrigerant flow from a compressor to each refrigerant path, the method including determining whether substantially all of the refrigerant is in at least one of the fresh food and freezer evaporators and returning the refrigerant to the compressor if substantially all of the refrigerant is not in at least one of the fresh food and freezer evaporators.

In a further aspect, a refrigerator includes a fresh food compartment having a fresh food evaporator, a fresh food door operable for opening and closing access to the fresh food compartment, and a fresh food defrosting assembly with a fresh food door counter for counting the number of fresh food door openings. The refrigerator also includes a freezer food compartment having a freezer evaporator, a freezer food door operable for opening and closing access to the freezer food compartment, a freezer food defrosting assembly with a freezer food door counter for counting the number of freezer food door openings. The refrigerator further includes a controller operationally coupled to the fresh food and freezer food defrosting assemblies and the fresh food and freezer food door counters. The controller is configured to adjusting the fresh food door counter when the fresh food door is opened, adjusting the freezer food door counter when the freezer food door is opened, updating the fresh food door counter when the fresh food compartment is cooled by the fresh food evaporator, and updating the freezer food door counter when the freezer food compartment is cooled by the freezer evaporator.

BRIEF DESCRIPTION OF THE DRAWINGS

FIG. 7 is a diagram of a control grid for operating a refrigerator;

DETAILED DESCRIPTION OF THE INVENTION

Figure 1:
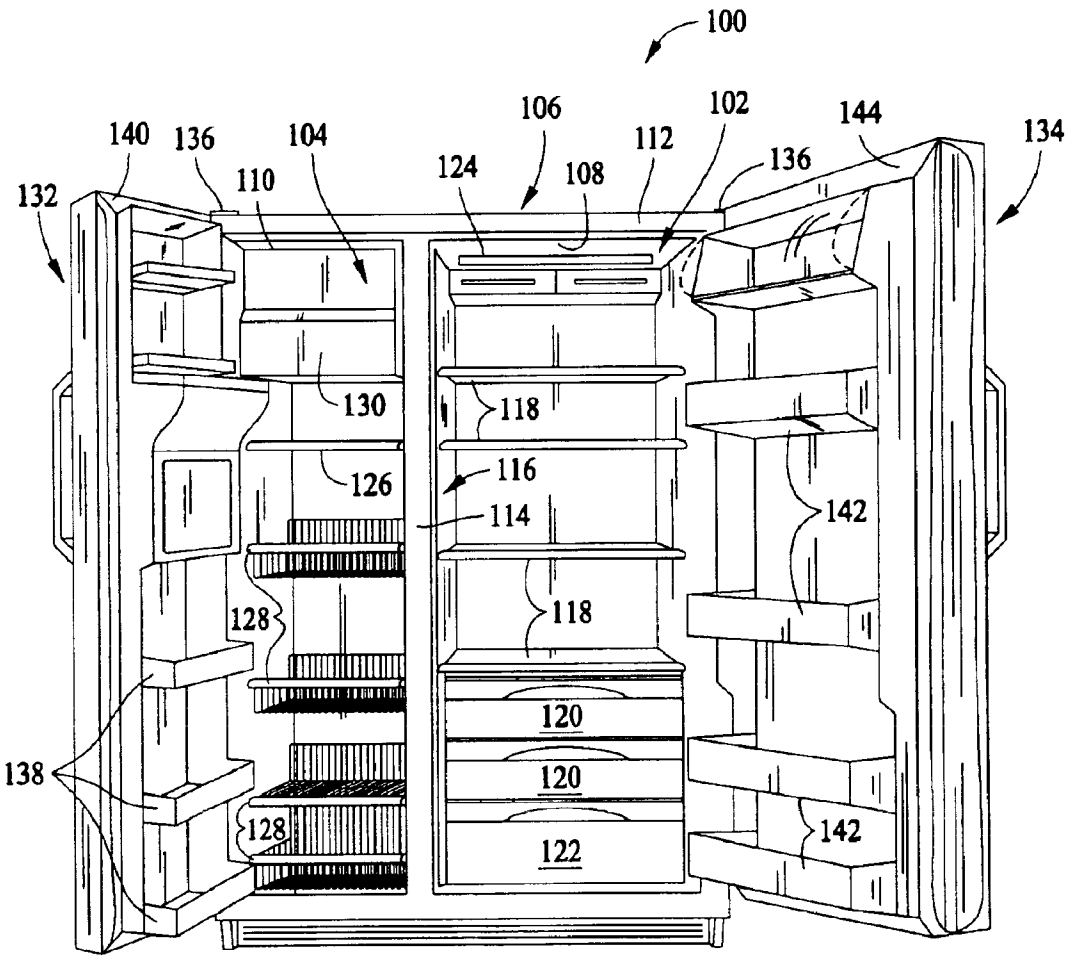
FIG. 1 is a perspective view of a refrigerator.

FIG. 1 illustrates a side-by-side refrigerator 100 including a fresh food storage compartment 102 and freezer storage compartment 104. Freezer compartment 104 and fresh food compartment 102 are arranged side-by-side. In one embodiment, refrigerator 100 is a commercially available refrigerator from General Electric Company, Appliance Park, Louisville, Ky. 40225, and is modified to incorporate the herein described methods and apparatus.

It is contemplated, however, that the teaching of the description set forth below is applicable to other types of refrigeration appliances, including but not limited to top and bottom mount refrigerators wherein undesirable temperature gradients exist. The present invention is therefore not intended to be limited to be limited to any particular type or configuration of a refrigerator, such as refrigerator 100.

Refrigerator 100 includes a fresh food storage compartment 102 and a freezer storage compartment 104 contained within an outer case 106 and inner liners 108 and 110. A space between case 106 and liners 108 and 110, and between liners 108 and 110, is filled with foamed-in-place insulation. Outer case 106 normally is formed by folding a sheet of a suitable material, such as pre-painted steel, into an inverted U-shape to form top and side walls of case. A bottom wall of case 106 normally is formed separately and attached to the case side walls and to a bottom frame that provides support for refrigerator 100. Inner liners 108 and 110 are molded from a suitable plastic material to form freezer compartment 104 and fresh food compartment 102, respectively. Alternatively, liners 108, 110 may be formed by bending and welding a sheet of a suitable metal, such as steel. The illustrative embodiment includes two separate liners 108, 110 as it is a relatively large capacity unit and separate liners add strength and are easier to maintain within manufacturing tolerances. In smaller refrigerators, a single liner is formed and a mullion spans between opposite sides of the liner to divide it into a freezer compartment and a fresh food compartment.

A breaker strip 112 extends between a case front flange and outer front edges of liners. Breaker strip 112 is formed from a suitable resilient material, such as an extruded acrylo-butadiene-styrene based material (commonly referred to as ABS).

The insulation in the space between liners 108, 110 is covered by another strip of suitable resilient material, which also commonly is referred to as a mullion 114. Mullion 114 also preferably is formed of an extruded ABS material. Breaker strip 112 and mullion 114 form a front face, and extend completely around inner peripheral edges of case 106 and vertically between liners 108, 110. Mullion 114, insulation between compartments, and a spaced wall of liners separating compartments, sometimes are collectively referred to herein as a center mullion wall 116.

Shelves 118 and slide-out drawers 120 normally are provided in fresh food compartment 102 to support items being stored therein. A bottom drawer or pan 122 partly forms a quick chill and thaw system (not shown) and selectively controlled, together with other refrigerator features, by a microprocessor (not shown in FIG. 1) according to user preference via manipulation of a control interface 124 mounted in an upper region of fresh food storage compartment 102 and coupled to the microprocessor. A shelf 126 and wire baskets 128 are also provided in freezer compartment 104. In addition, an ice maker 130 may be provided in freezer compartment 104.

A freezer door 132 and a fresh food door 134 close access openings to fresh food and freezer compartments 102, 104, respectively. Each door 132, 134 is mounted by a top hinge 136 and a bottom hinge (not shown) to rotate about its outer vertical edge between an open position, as shown in FIG. 1, and a closed position (not shown) closing the associated storage compartment. Freezer door 132 includes a plurality of storage shelves 138 and a sealing gasket 140, and fresh food door 134 also includes a plurality of storage shelves 142 and a sealing gasket 144.

In accordance with known refrigerators, refrigerator 100 also includes a machinery compartment (not shown) that at least partially contains components for executing a known vapor compression cycle for cooling air. The components include a compressor (not shown in FIG. 1), a condenser (not shown in FIG. 1), an expansion device (not shown in FIG. 1), and an evaporator (not shown in FIG. 1) connected in series and charged with a refrigerant. The evaporator is a type of heat exchanger which transfers heat from air passing over the evaporator to a refrigerant flowing through the evaporator, thereby causing the refrigerant to vaporize. The cooled air is used to refrigerate one or more refrigerator or freezer compartments via fans (not shown in FIG. 1). Collectively, the vapor compression cycle components in a refrigeration circuit, associated fans, and associated compartments are referred to herein as a sealed system. The construction of the sealed system is well known and therefore not described in detail herein, and the sealed system is operable to force cold air through the refrigerator subject to the following control scheme.

Figure 2:
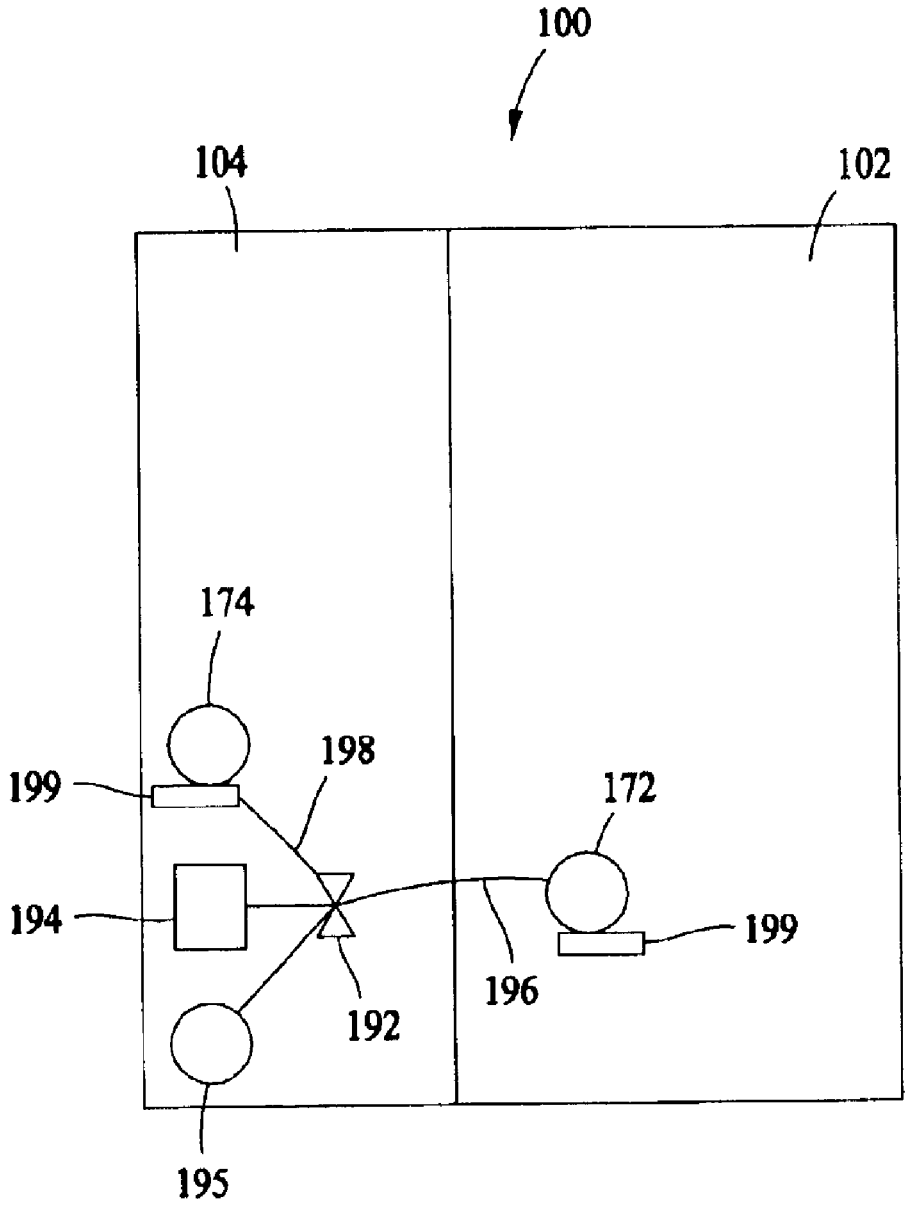
FIG. 2 is a schematic illustration of the exemplary refrigerator.

FIG. 2 is schematic illustration of refrigerator 100. During operation of refrigerators with a fresh food evaporator 172 and a freezer evaporator 174, a three-way valve 192 with a step motor 194 is utilized to switch refrigerant flow from one evaporator to another depending on the temperatures in fresh food and freezer compartments 102 and 104. A compressor 195 delivers refrigerant to fresh food evaporator 172 via a path to fresh food evaporator 196 and to freezer evaporator 174 via a path to freezer evaporator 198. Three-way valve 192 has at least a first outlet (not shown) coupled to path to fresh food evaporator 196 and a second outlet coupled to the path to freezer evaporator 198. In one embodiment, a heating unit 199 is coupled to at least one of fresh food evaporator 172 and freezer evaporator 174. In another embodiment, heating unit 199 is positioned proximate to at least one of fresh food and freezer evaporators 172 and 174. Each mode of the refrigeration system a operation requires different compressor pressure ratios. In known systems, there are considerable transition loses switching between modes because of the short time it takes for valve 192 to switch to various valve positions.

Step motor 194 of three-way valve 192 operates by a series of impulses that moves valve 192 incrementally in a plurality of steps between a plurality of operation modes or positions. These operation positions include position A, where only the first outlet port is open; position B, where the first outlet port is closed and the second outlet port is open; position C, where both the first and second outlet ports are open; and position D, where both outlet ports are closed. Because there is no time delay between the impulses, the time interval between the steps is short, such as hundreds or even thousands of a millisecond. Thus, valve 192 moves from one position to another for less than 1 to 10 seconds. To maintain smooth transition from one operation position to another of the sealed refrigeration system, an algorithm for the step motor valve 192 includes a delay time added to every operation position. In one embodiment, a delay time is an EEPROM valve and is different for each valve operation position. For example, when valve 192 moves from position A (first outlet port is open) to position C (both outlet ports are open) the time interval is a first time period t1. When valve 192 moves from position C to position B (second outlet port is open) the time interval is a second time period t2. When valve 192 moves from position B to position D (both outlet ports are closed) the time interval is a third time period t3, and so on. In one embodiment, first, second and third time periods t1, t2 and t3 are of different time duration.

Figure 3:
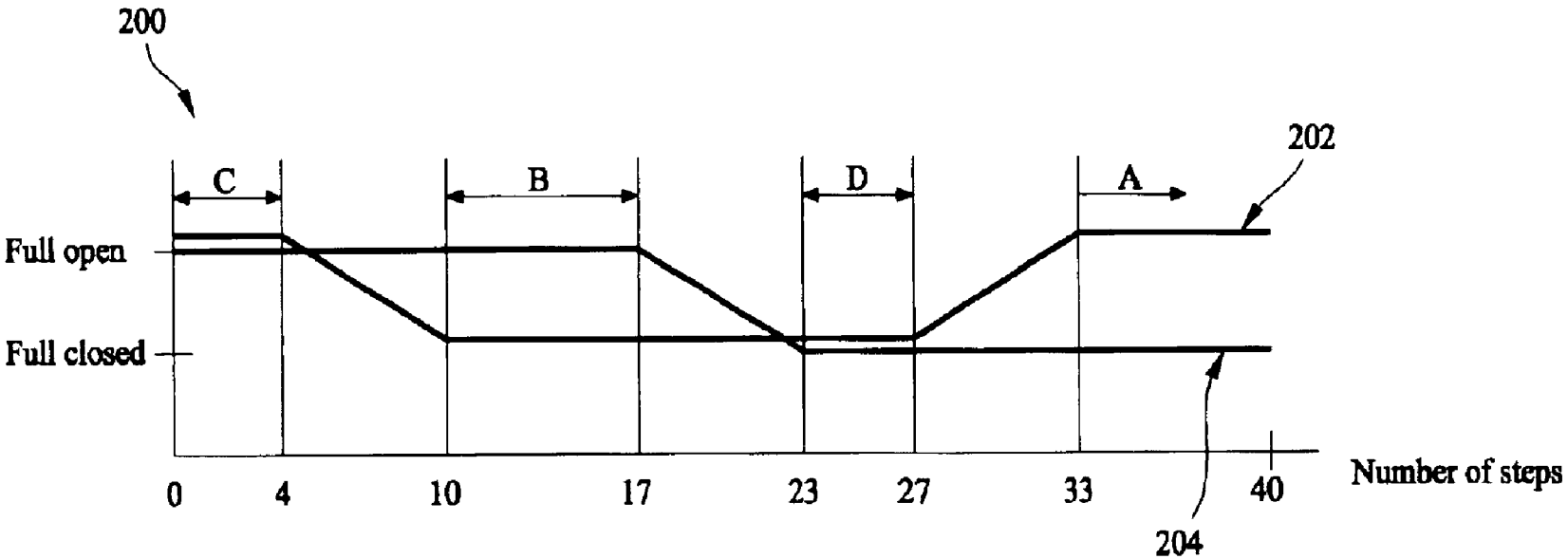
FIG. 3 is a step diagram of a valve between an open position and a closed position for a refrigerant path to a fresh food evaporator and a path to a freezer evaporator.

FIG. 3 is a step diagram 200 for a method of operating valve positions for a refrigerant path to fresh food evaporator 202 and a refrigerant path to freezer evaporator 204. From steps 0 to 4 the valve 192 (in position C) directs flow to both fresh food and freezer evaporators 172 and 174. From step 4 to step 10, valve 192 closes path to fresh food evaporator 202. From step 10 to step 17, valve 192 is in B position and only path to freezer evaporator 204 is open. From step 17 through step 23, path to freezer evaporator 204 closes. From step 23 through step 27, both paths 202 and 204 are closed and valve 192 is in position D. From step 27 through step 33, valve 192 opens path to fresh food evaporator 202. From step 33 to 40, valve 192 is in position A, which results in opening path to fresh food evaporator 202 and closing path to freezer evaporator 204.

Figure 4:
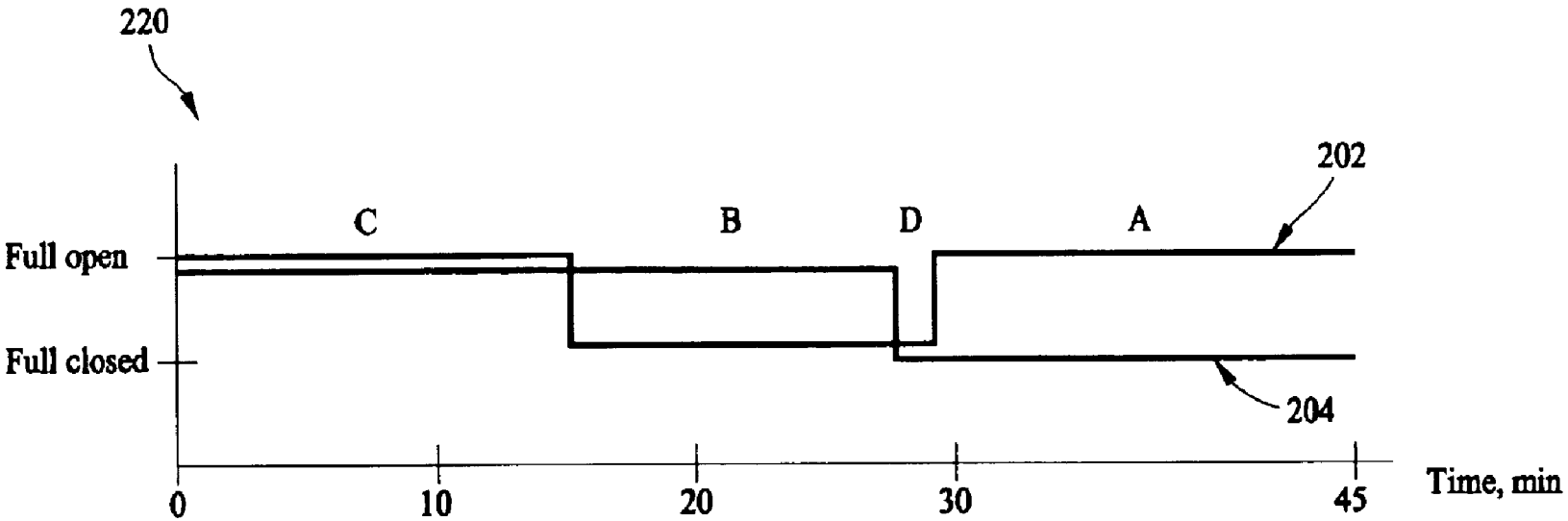
FIG. 4 (Prior Art)
FIG. 4 is a known time diagram of a valve between an open position and a closed position for a refrigerant path to a fresh food evaporator and a path to a freezer evaporator.

FIG. 4 is a time diagram 220 for a known method of valve positioning. Time diagram 220 of FIG. 3 has the same four valve operational positions of A, B, C, and D of FIG. 3. For about 15 minutes, valve 192 is in position C (both paths 202 and 204 are open stepwise in any position between steps 0 and 4 (see FIG. 3)) and then abruptly, (for less than 2 sec.) valve 192 goes into position B, where path to fresh food evaporator 202 is closed in any position between steps 10 and 17 (see FIG. 3). Then again abruptly, valve 192 is in position D in which both paths 202 and 204 are closed in any position between steps 23 and 27 (see FIG. 3). Then valve 192 is in position A and path to freezer evaporator 204 is closed and path to fresh food evaporator 202 is open, in any position between steps 33 and 40 (see FIG. 3). In one embodiment, the sequence of operations may be different. For example, immediately after position C, valve 192 may go to position D between steps 23 and 27, then to position A (between step 33 and 40) or to position B (between steps 10 and 17), and so on.

Figure 5:
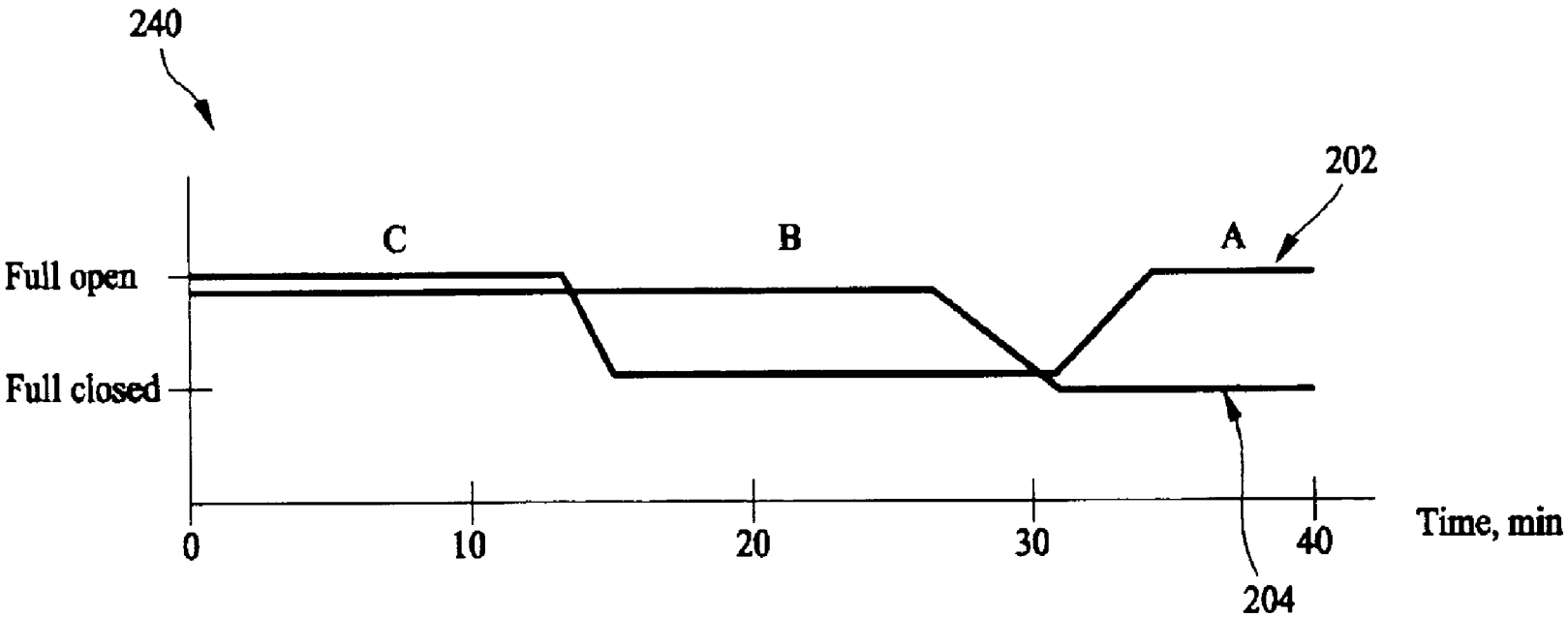
FIG. 5 is a time diagram of a valve between an open position and a closed position for a refrigerant path to a fresh food evaporator and a path to a freezer evaporator.

FIG. 5 is a time diagram 240 for a method of valve positioning. Time diagram 240 of FIG. 4 has four valve operation positions of A, B, C, and D. For about 13 minutes, valve 192 is in position C (both paths 202 and 204 are open stepwise in any position between steps 0 and 4). Then with time delay of, for example, 10 seconds per step, valve 192 goes to position B where path to freezer evaporator 204 is open and path to fresh food evaporator 202 is closed in any position between steps 10 and 17 (see FIG. 3). In one embodiment, the transition is between approximately 0 to 4 minutes. In another embodiment, the transition is about 15 steps or about 2.5 minutes. The transition from position C to position B with the time delay is very gradual. During the transition from position B to position A, the time delay between steps is, for example, about 20 seconds. The transition starts between steps 10 and 17 (see FIG. 3) and finishes between steps 33 and 40 (see FIG. 3). In one embodiment, the transition is between approximately 2 to 10 minutes. In another embodiment, the transition is about 8 minutes. Because the transition from one valve position to another valve position is gradual, the amount of time valve 192 is at position D is only about a single step. When valve 192 changes between operation positions in the refrigerant circuit, the transition is long enough to provide the best energy efficiency of the system.

As discussed above, refrigerator 100 includes fresh food evaporator 172 located in fresh food compartment 102 and a separate freezer evaporator 174 in freezer food compartment 104. Thus, refrigerant flows either through the fresh food evaporator 172 or through freezer evaporator 174. When refrigerant flows through fresh food evaporator 172, fresh food evaporator 172 is flooded with refrigerant. When refrigerant flows through freezer evaporator 174, refrigerant floods freezer evaporator 174. Thus, it takes some time or requires a special recovery mode to transmit refrigerant from one evaporator to compressor 195 and then to another evaporator. In addition, defrosting of either the fresh food or freezer evaporators 172 and 174 is enhanced with supplemental heating of refrigerant in evaporators 172 and 174, such as heat from a defroster heater (not shown).

Figure 6:
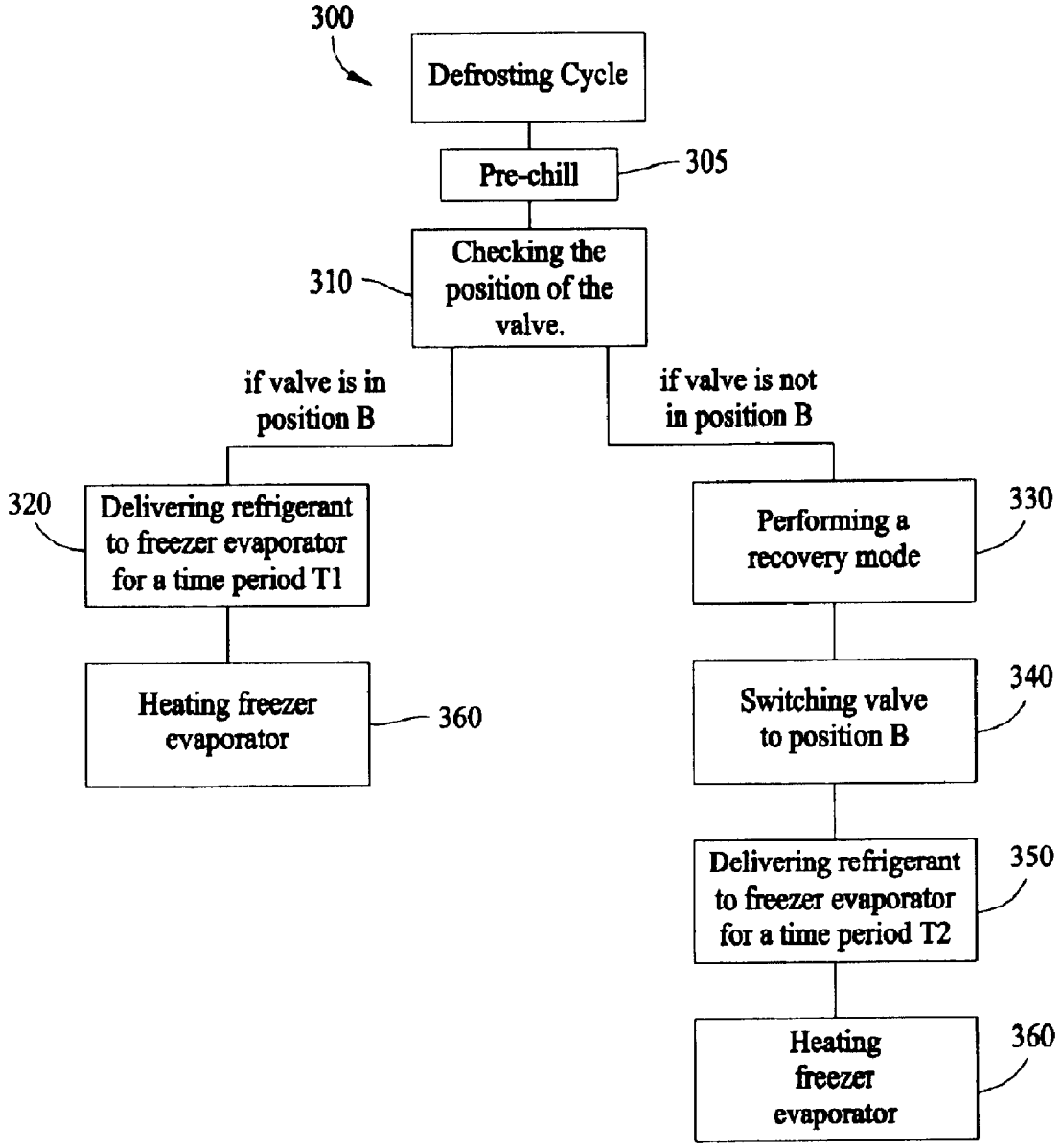
FIG. 6 is a flow diagram of a defrosting cycle.

FIG. 6 shows a defrosting cycle 300 for fresh food and freezer evaporators 172 and 174. Refrigerator 100 includes a defrost timer (not shown). When the defrost timer counts down to zero, a pre-chill cycle is started 305 and cools the fresh food and freezer compartments 102 and 104 to a certain temperature. As soon as temperatures in both compartments reach a predetermined level, valve 192 is set into position to flow refrigerant through the evaporator to be defrosted for a predetermined time, i.e. about 10 min. During defrost operation, valve 192 stays in the pre-defrost position. After this time expires, compressor 195 is switched off and the heater comes on until the evaporator reaches a fixed temperature.

In one embodiment, defrosting method 300 includes the step of checking or determining 310 the position of valve 192. If valve 192 is in position B, compressor 195runs or delivers 320 refrigerant to freezer evaporator 174 to be defrosted for predetermined first time (T1) before starting a defrost operation. If valve 192 is not in position B, defrosting cycle 300 performs a recovery mode. Recovery mode includes returning 330 refrigerant back to compressor 195 from fresh food evaporator 172. After refrigerant is recovered from fresh food evaporator 172, valve 192 is switched 340 to position B. Compressor 195 then runs or delivers 350 refrigerant to freezer evaporator 174 to be defrosted for a predetermined second time (T2) before starting a defrost operation, where T1>T2.

In another embodiment, defrosting method 300 includes the step of checking whether or not valve 192 is in position A. If valve 192 is in position A, compressor 195 runs or delivers 320 refrigerant to fresh food evaporator 172 to be defrosted for predetermined first time (T1) before starting a defrost operation. If valve 192 is not in position recovery mode returns 330 refrigerant back to compressor 195 from freezer evaporator 174. After refrigerant is recovered from freezer evaporator 174, valve 192 is switched 340 to position A. Compressor 195 then runs or delivers 350 refrigerant to fresh food evaporator 172 to be defrosted for a predetermined second time (T2) before starting a defrost operation, where T1>T2.

In one embodiment, the defroster heater heats 360 the lower portion of either fresh food or freezer evaporators 172 and 174. The defroster heater heats the refrigerant in the evaporator until the refrigerant evaporates and migrates upward through the evaporator. As the refrigerant rises, the refrigerant cools until it liquefies, whereby the refrigerant returns (due to gravity) to the lower portion of the evaporator again to repeat the process.

In one embodiment, multiple speed compressor and fan logic is utilized to increase cooling efficiency and decrease energy consumption. Based on the temperatures of the cabinet, the position of the valve 192, the speeds of compressor 195, freezer fan 190, the fresh food fan 182 and the condenser fan are all determined and compared with a control grid 380, as shown in FIG. 7. Control grid 380 includes fresh food compartment temperature on an x-axis and freezer food compartment temperature on a y-axis.

Control grid 380 is divided into 8 sections or areas numbering from Area 0 to Area 7, wherein some Areas are derivative sensitive. For example, in some areas, control grid 380 takes into account whether the previous area had a increase in temperature (ie. the temperature has a negative derivative). In other areas, control grid 380 takes into account whether the previous area had a decrease in temperature (ie. the temperature has a positive derivative).

Area 0 includes cells 24Y, 25Z, and 26AA. Area 1 includes cells 2C, 3D, 4E, 5F, 11L, 17R and 23×. Area 2 includes cells 8I, 9J, 10K, 16Q, and 22W. Area 3 includes cells 14O, 15P, and 21V. Area 4 includes cell 20V. Area 5 includes cells 0A, 1B, 6G, 7H, 12M, 13N, 18S, and 19T. Area 6 includes cells 27AB, 28AC, and 29AD. Area 7 includes cells 32AH, 33AH, 34AI, and 35AJ.

In Area 0 of the control grid, all the fans and compressor 195 are shut down and valve 192 is in position A. When the system enters Area 1, which is far from a setpoint 390, sealed system runs with a higher capacity in order to move towards the setpoint. Valve 192 is usually in position C thereby refrigerating both the evaporators. When the system is moving towards the setpoint in Area 2, the system maintains Area 1 settings in order to pull down efficiently. Otherwise, the sealed system and fans 182 and 190 run in medium speeds and valve 192 is in positions A or C depending on the distance from setpoint.

If the system is moving towards setpoint in Area 3 from Area 1, Area 2 settings come into effect in Area 3. Otherwise, sealed system and fans 182 and 190 run in low speeds. When the system enters Area 4, the system experiences no change. In Area 5, valve 192 is in position B (freezer evaporator only) and thus only freezer evaporator 174 is cooled until it reaches the setpoint. (However, in cell 19T, when compressor 195 is not on, valve 192 is in position A). In Area 6, valve 192 is in position A (fresh food evaporator only) and only fresh food evaporator 172 is cooled until it reaches the setpoint. In Area 7, the sealed system and fans 182 and 190 run in middle speeds except the condenser fan which operates in a higher speed. This mode helps the system to be stable in high ambient conditions.

Figure 8:
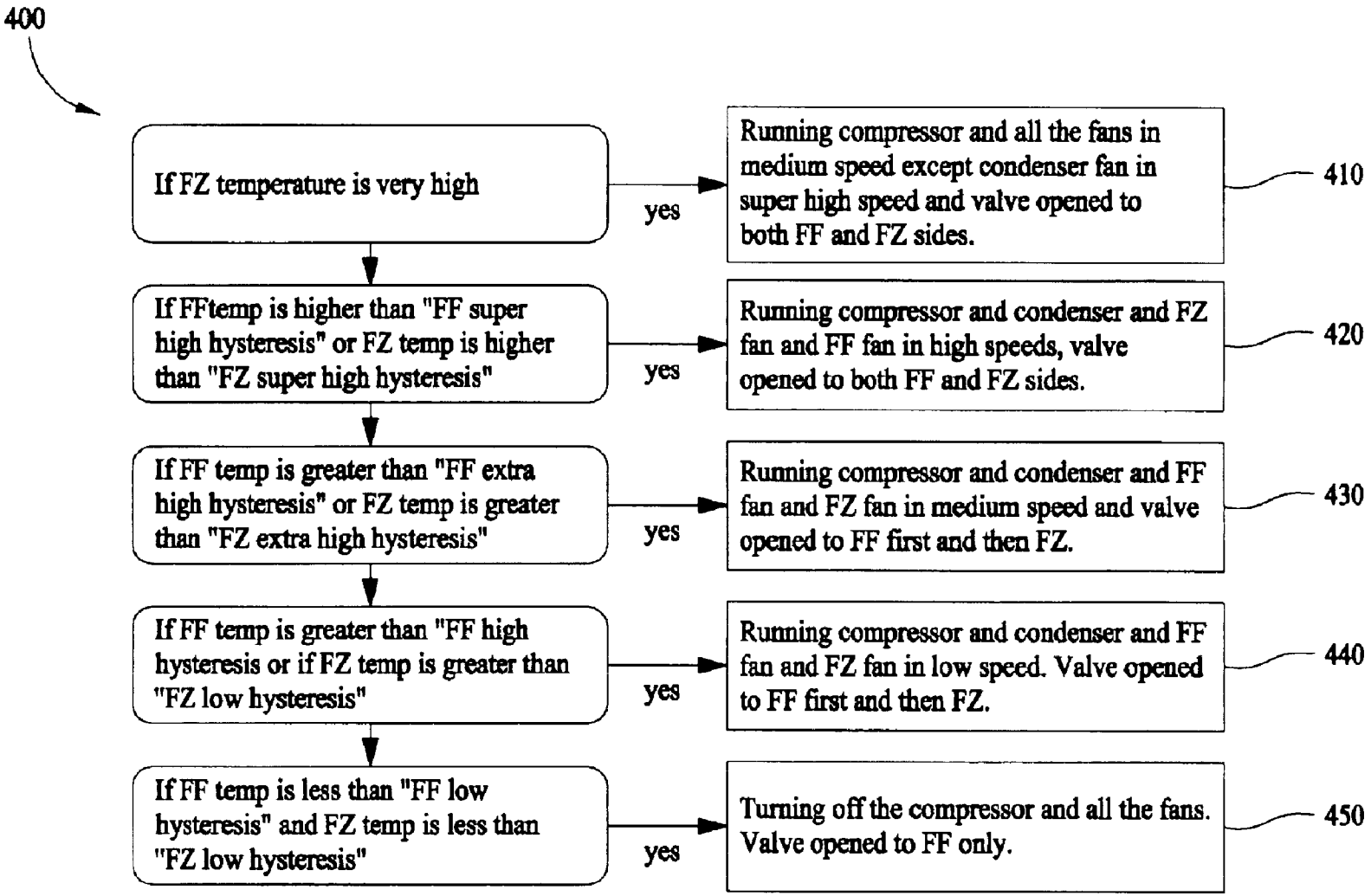
FIG. 8 is a flow diagram of the control grid of FIG. 7.

FIG. 8 is a flow diagram 400 of control grid 380. If freezer temperature is high, step 410 runs compressor 195 and all the fans in medium speed except for condenser fan, which is run in super high speed. In step 410, valve 192 is in position C. If the fresh food compartment temperature is higher than the fresh food compartment super high hysteresis or if freezer food compartment temperature is higher than the freezer food compartment super high hysteresis, then step 420 runs the compressor, the condenser freezer fan, and fresh food fan 182 at high speeds. Valve 192 in step 420 is in position C. If fresh food compartment temperature is greater than fresh food compartment extra high hysteresis or freezer food, compartment temperature is greater than freezer food compartment extra high hysteresis, then step 430 runs compressor, condenser, fresh food fan 182 and freezer fan 190 at medium speed. In step 430, valve 192 is in position C, whereby path to fresh food evaporator 196 is opened first and then path to the freezer evaporator 198 is opened. If the fresh food compartment temperature is greater than the fresh food compartment high hysteresis or if freezer food compartment temperature is greater than freezer food compartment low hysteresis, then step 440 runs compressor, condenser, fresh food fan 182 and freezer fan 190 in low speed. In step 440, valve 192 opens path to fresh food evaporator 196 first and then opens path to freezer evaporator 198. If fresh food compartment temperature is less than fresh food low hysteresis and freezer food compartment temperature is less than freezer food low hysteresis, then step 450 turns off compressor 195 and all the fans. In step 450, valve 192 only opens path to fresh food evaporator 196.

Fresh food compartment 102 has a fresh food defrosting assembly (not shown) with a fresh food door counter (not shown) for counting the number of fresh food door openings before executing the defrosting operation. Freezer food compartment 104 has a freezer food defrosting assembly (not shown) with a freezer food door counter (not shown) for counting the number of freezer door openings before executing the defrosting operation. A controller (not shown) is operationally coupled to the fresh food and freezer defrost assemblies and the fresh food and freezer door counters. Once the respective door has been opened a specific number of times, the controller starts the defrost operation for that refrigerator compartment. Thus, door counter records the number of door opening by either incrementing or decrementing each door opening until the given number of door openings have been reached.

Figure 9:
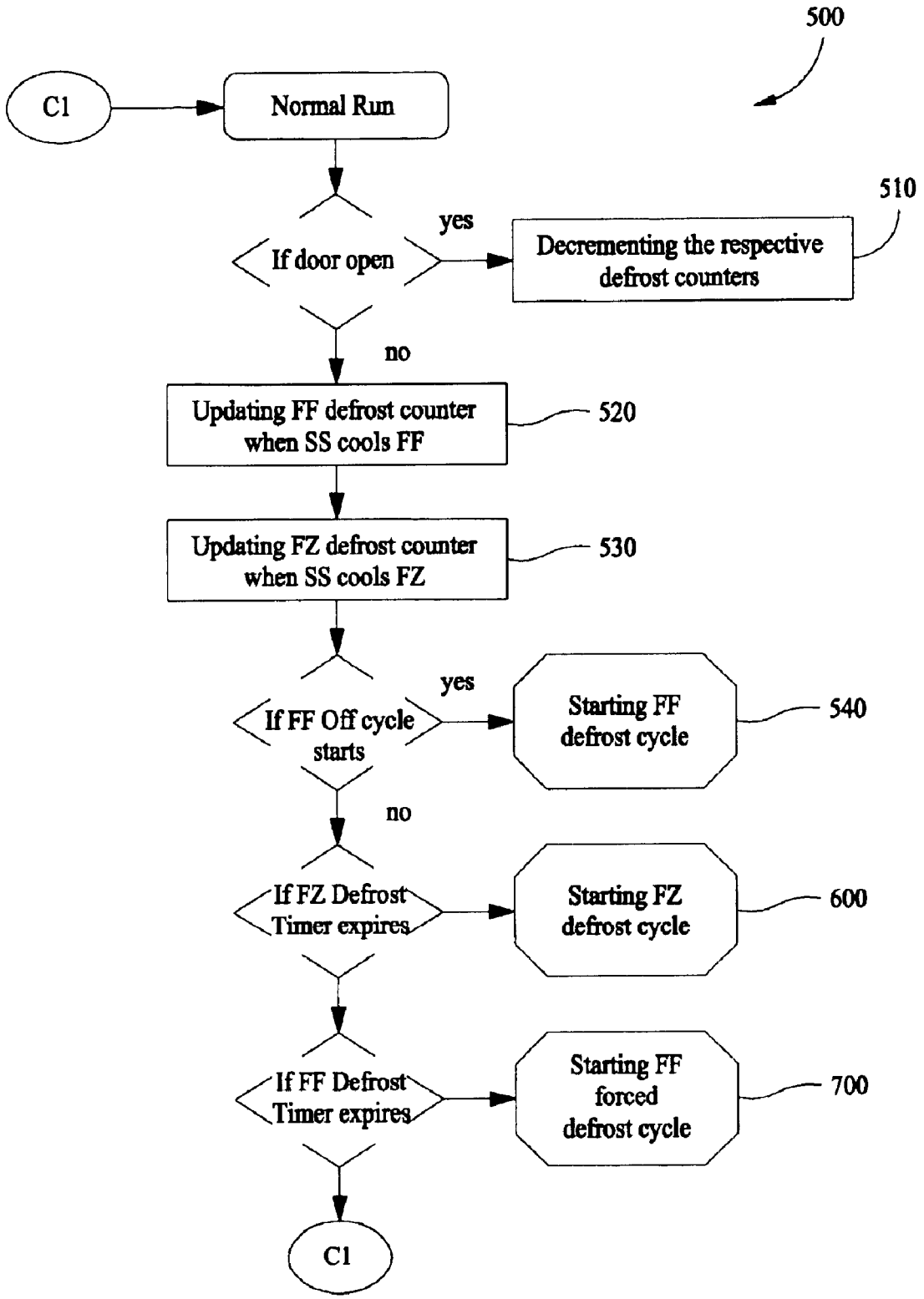
FIG. 9 is a flow diagram of a defrosting operation of a fresh food evaporator and a freezer evaporator.

FIG. 9 is a flow diagram of a defrosting operation of fresh food and freezer evaporators 172 and 174 based on an adaptable defrost algorithm 500, which incorporates door openings and the sealed system run time in freezer food compartment 104. Fresh food evaporator 172 is defrosted using fresh food fan 182 that operates according to the adaptable defrost algorithm, shown in FIG. 9, which incorporates door openings and sealed system run time in fresh food compartment 102. Three-way valve 192 is used to control the refrigerant flow between the fresh food and freezer food compartments 102 and 104. In the defrost algorithm of FIG. 9, the fresh food door openings are counted only for fresh food evaporator 172, and the freezer food door openings are only counted for freezer evaporator 174.

In one embodiment, only fresh food door counter decrements 510 when the fresh food door is opened. In another embodiment, only fresh food door counter increments when the fresh food door is opened. In one embodiment, only freezer food door counter decrements 510 when the freezer door is opened. In another embodiment, only freezer food door counter increments when the fresh food door is opened.

If the fresh food door is not opened, then the controller updates 520 the fresh food door counter when the sealed system cools fresh food compartment 102. If the freezer food door is not opened, then the controller updates 530 the freezer food door counter when the sealed system cools freezer food compartment 104.

Figure 10:
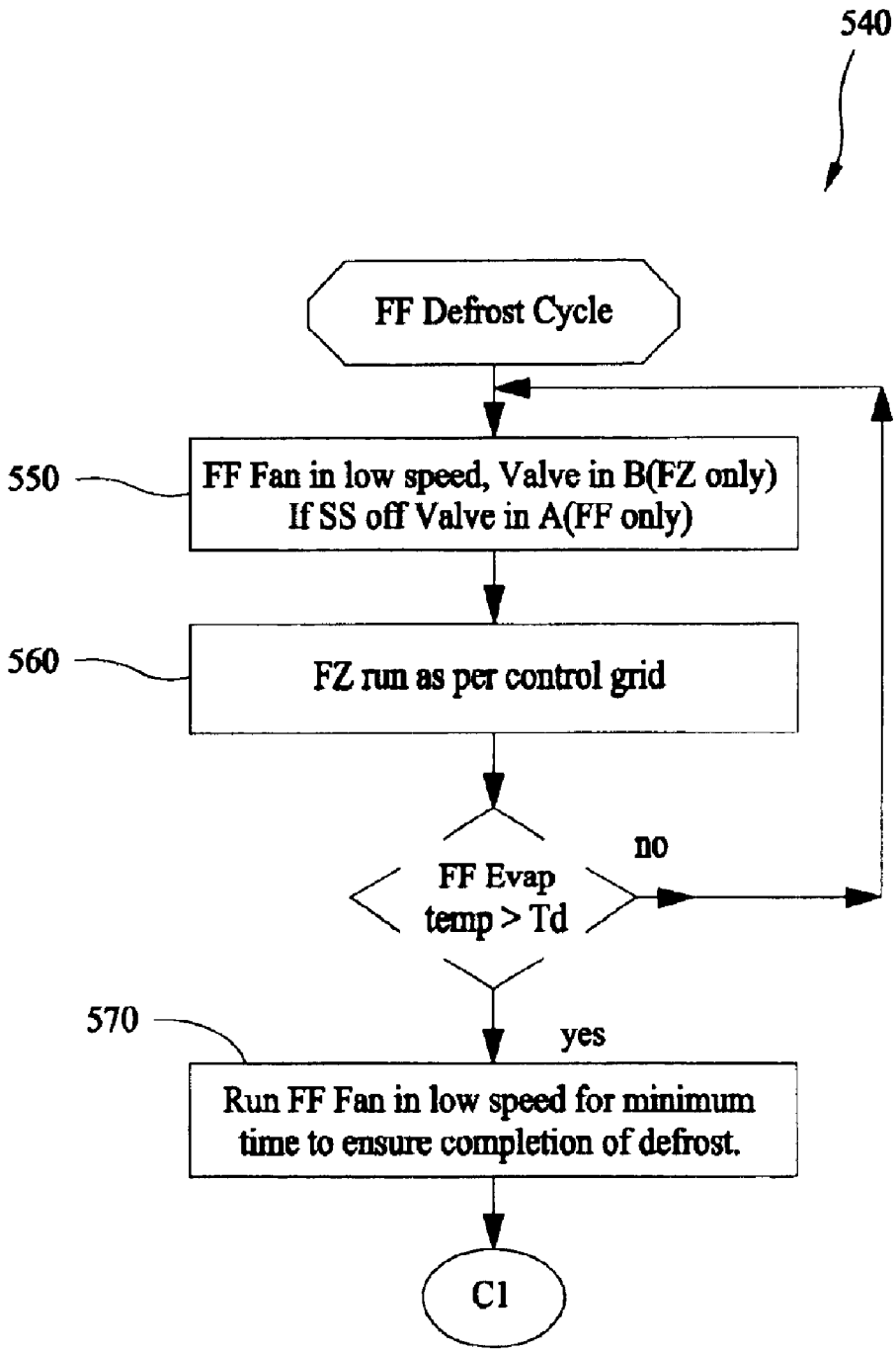
FIG. 10 is a flow diagram of fresh food defrosting cycle.

If fresh food compartment is not being cooled (off cycle), then the controller starts 540 fresh food normal defrost cycle. FIG. 10 shows a fresh food defrost cycle 540. Fresh food defrost cycle 540 sets 550 fresh food fan 182 in low speed and moves the valve 192 into position B. If the sealed system is off, then valve 192 is moved to position A. Fresh food defrost cycle runs 560 freezer food compartment 104 according to control grid 380 of FIG. 7. If the temperature of the fresh food evaporator 172 is less than the defrosting temperature, then steps 550 and 560 are repeated. If the temperature of the fresh food evaporator 172: is greater than the defrosting temperature, then fresh food defrost cycle runs 570 fresh food fan 182 in a low speed for the minimum time to ensure completion of the defrost operation.

The controller of adaptable defrost algorithm 500 does not count fresh food door openings for the freezer defrost decrement timer. As the freezer defrost timer expires (sealed system run time in freezer side, time corresponding to number of freezer door openings and duration of freezer door openings) for abnormal defrost timer or normal defrost timer, the controller starts a freezer defrost cycle 600.

Figure 11:
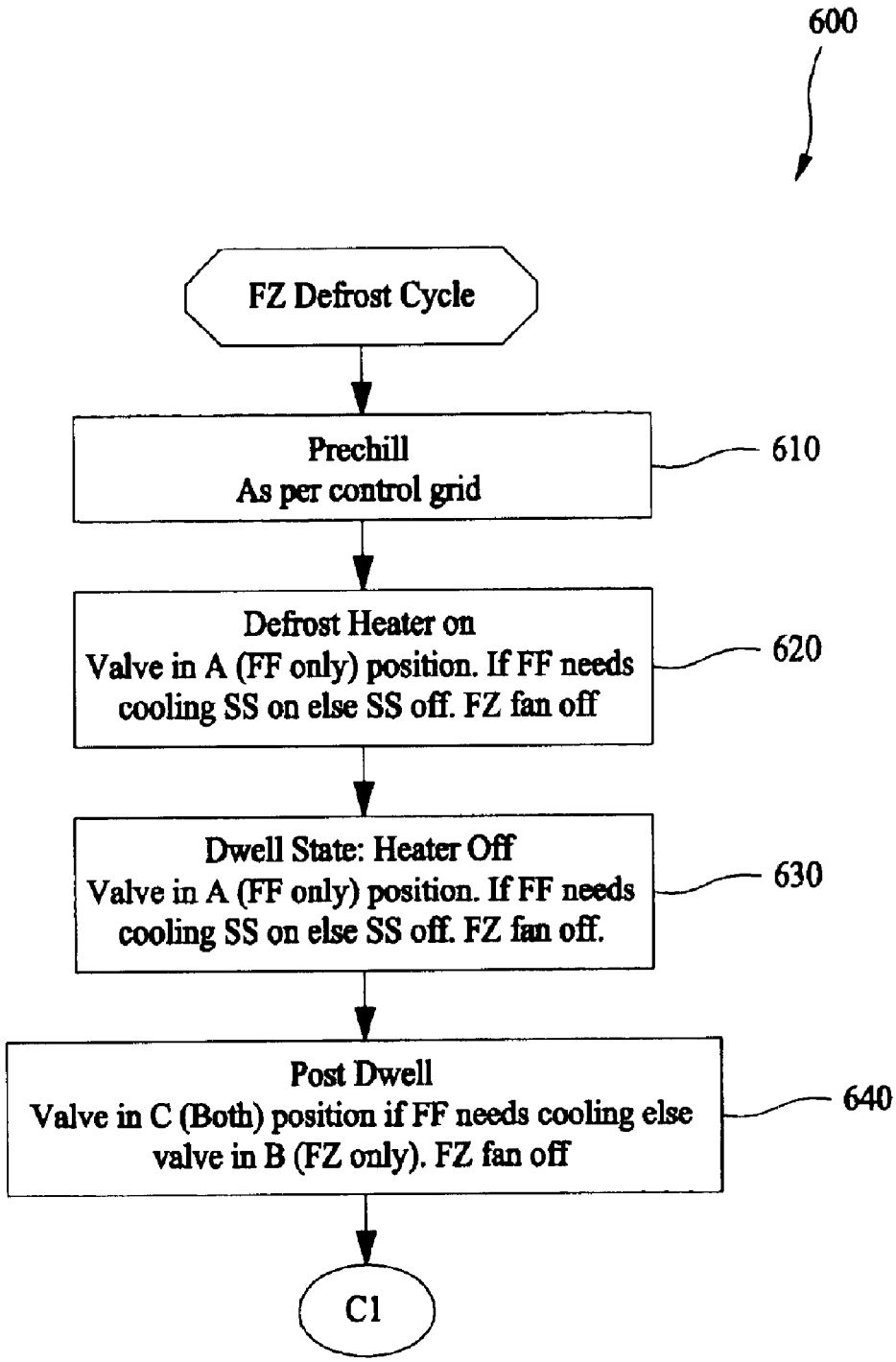
FIG. 11 is a flow diagram of a freezer food compartment defrosting cycle.

FIG. 11 shows freezer defrost cycle 600. Freezer evaporator 174 pre-chills 610 and cools freezer compartment 104 to a certain temperature according to control grid 380 of FIG. 7. Once the defrost timer counts down to zero or expires, the sealed system is switched away from freezer compartment 104, valve 192 is moved to position A, and a defrost heater heats 620 freezer evaporator 174 until freezer evaporator 174 reaches a fixed temperature. If fresh food compartment 102 needs further cooling, the sealed system is switched on, otherwise the sealed system is off and freezer fan 190 is off.

During the dwell time of freezer defrost cycle 600, valve 192 is in position A and the defrost heater is turned off 630.

No fans or sealed system are turned on in freezer food compartment 104. If fresh food compartment 102 needs further cooling, the sealed system is switched on, otherwise the sealed system is off and freezer fan 190 is off. After the dwell time (post dwell time), step 640 cools freezer evaporator 174 by turning off the sealed system in freezer compartment 104 while freezer fan 190 remains off. In post dwell time, valve 192 moves to position C, if fresh food compartment 102 needs cooling. Otherwise, valve 192 is in position B. After the post dwell time, the controller goes back to the normal state and operates according to control grid 380. During freezer defrost cycle 600, fresh food compartment 102 runs according to control grid 380.

Figure 12:
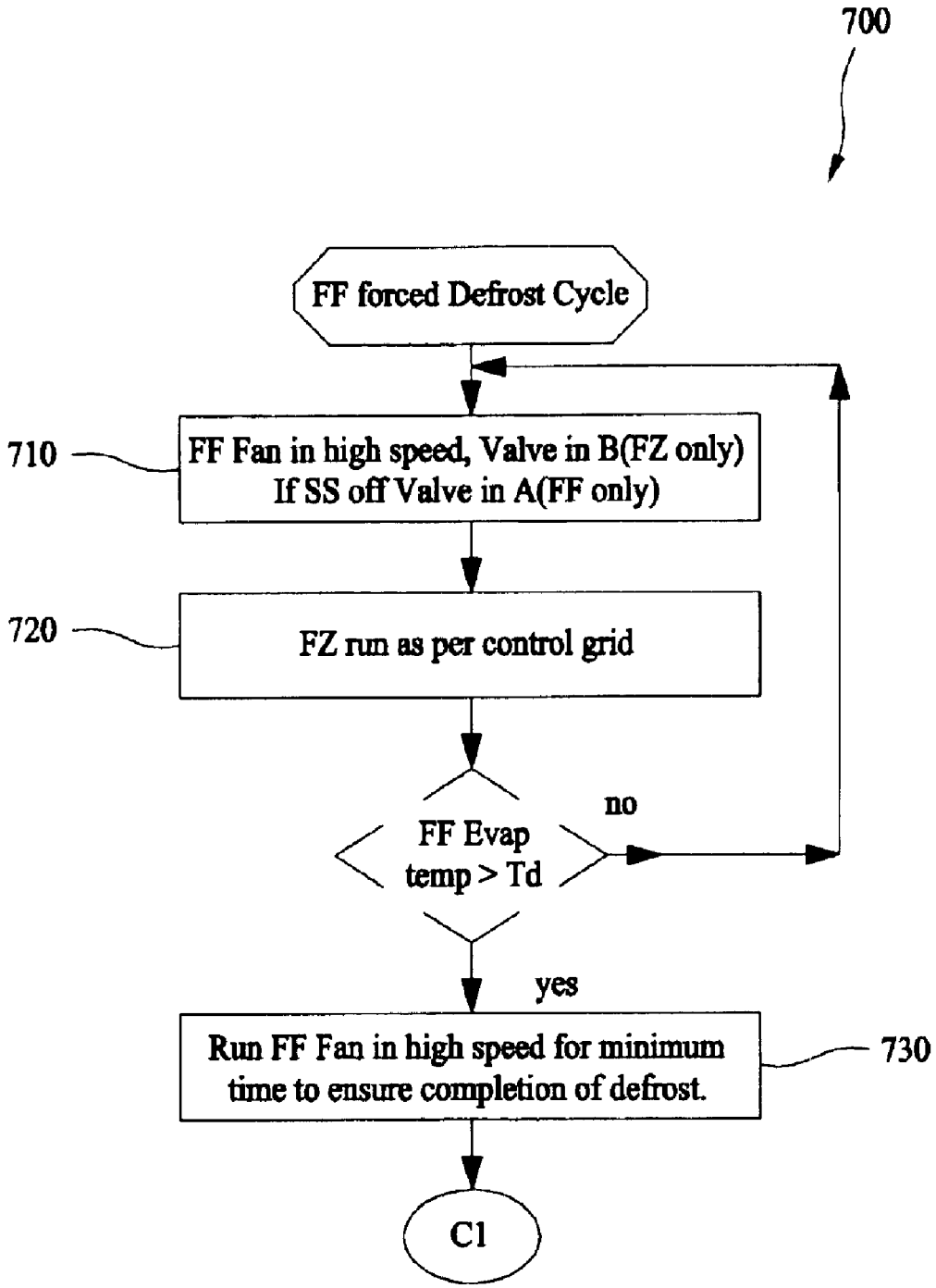
FIG. 12 is a flow diagram of a forced fresh food compartment defrosting cycle.

After the fresh food defrost timer counts down to zero or expires, the controller starts forced defrost cycle 700. FIG. 12 shows forced defrost cycle 700. In step 710, valve 192 is moved to position B, the sealed system in fresh food compartment 102 is off, and fresh food fan 182 is running 710 in high speed until fresh food evaporator 172 reaches a certain temperature, after which fresh food fan 182 is kept running for a minimum time to ensure completion of the defrosting operation. During fresh food defrost cycle 700, freezer food compartment 104 runs 720 according to control grid 380. If the temperature of fresh food evaporator 172 is less than the defrost temperature, then steps 710 and 720 are repeated. If the temperature of fresh food evaporator 172 is greater than the defrost temperature, then fresh food fan 182 is run 730 in high speed for a minimum amount of, time to ensure completion of the defrost operation.

Exemplary embodiments of refrigerator systems are described above in detail. The systems are not limited to the specific embodiments described herein, but rather, components of each assembly may be utilized independently and separately from other components described herein. Each refrigerator component can also be used in combination with other refrigerator and evaporator components.

While the invention has been described in terms of various specific embodiments, those skilled in the art will recognize that the invention can be practiced with modification within the spirit and scope of the claims.

What is claimed is:

1. A method of switching refrigerant flow between a path to a fresh food evaporator in a fresh food compartment and a path to a freezer evaporator in a freezer food compartment of a refrigerator using a three way valve, said method comprising:

providing the three way valve with a plurality of operation positions, the three way valve having a plurality of steps between each of the plurality of operation positions; and moving the three way valve incrementally in steps with a time delay between consecutive steps between at least two operation positions such that the three way valve transitions between at least two operation positions gradually.

2. A method according to claim 1, wherein providing a three way valve with at least three operating positions wherein the three way valve transitions from a first operating position to a second operating position for a first time period T1 and the three way valve transitions from a second operating position to a third operating position for a second time period T2 different from first time period T1.

3. A method according to claim 1, wherein providing a three way valve with at least three operating positions wherein the three way valve transitions from a first operating position to a second operating position for a first time period T1 and the three way valve transitions from a second operating position to a third operating position for a second time period T2 different from first time period T1 wherein the first time period T1 is between approximately 1 and 4 minutes and the second time period T2 is between approximately 7 and 9 minutes.

4. A method according to claim 1, wherein providing a three way valve with at least three operating positions wherein the three way valve transitions from a first operating position to a second operating position for a first time period T1 and the three way valve transitions from a second operating position to a third operating position for a second time period T2 different from first time period T1 wherein the first time period T1 is between approximately 2 and 3 minutes and the second time period T2 is between approximately 6 and 10 minutes.

5. A method according to claim 1, wherein providing a three way valve with at least three operating positions wherein the three way valve transitions from a first operating position to a second operating position for a first time period T1 and the three way valve transitions from a second operating position to a third operating position for a second time period T2 different from first time period T1 wherein the first time period T1 is approximately 2.5 minutes and the second time period T2 is approximately 8 minutes.

6. A method according to claim 1, moving the three way valve incrementally in steps with a time delay between consecutive steps further comprises moving the three way valve incrementally in steps with a time delay of about ten seconds for each step.

7. A method for operating a refrigerator having a fresh food compartment and a freezer food compartment, said method comprising:

cooling the fresh food compartment with a fresh food evaporator using a control grid; and cooling the freezer food compartment with a freezer evaporator using the control grid.

8. A method according to claim 7 wherein cooling the fresh food compartment further comprises cooling the fresh food compartment using a control grid comprising a plurality of predefined areas wherein at least one area is derivative sensitive.

9. A method for defrosting a refrigerator having a refrigerant path to a freezer evaporator and a refrigerant path to a fresh food evaporator, and a three way valve for controlling refrigerant flow from a compressor to each refrigerant path, said method comprising:

selecting an evaporator to defrost between the fresh food evaporator and the freezer evaporator;

determining a status of the path to the selected evaporator as one of closed and open;

running the compressor in a recovery mode when the determined status of the path to the selected evaporator is closed; and running the compressor to deliver refrigerant to the selected evaporator when the determined status of the path to the selected evaporator is open.

10. A method according to claim 9 wherein running the compressor to deliver refrigerant to the selected evaporator further comprises running the compressor to deliver refrigerant to the selected evaporator for a first time period, and wherein running the compressor in a recovery mode further comprises running the compressor in a recovery mode for a second time period wherein first time period is different from second time period.

11. A method according to claim 9 further comprising:

switching the three way valve such that the path to the selected evaporator is open after running the compressor in the recovery mode.

12. A method according to claim 11, further comprising:

delivering refrigerant to the selected evaporator after switching the three way valve; and energizing a heater positioned proximate to the selected evaporator.

13. A method according to claim 9, further comprising energizing a heater positioned proximate to the selected evaporator.

* * * * *